US006168061B1

(12) United States Patent
Harrison

(10) Patent No.: US 6,168,061 B1
(45) Date of Patent: Jan. 2, 2001

(54) GOLF BALL HOLDER

(76) Inventor: Robert S. Harrison, 3352 Bloomfield Shores, W. Bloomfield, MI (US) 48323

( * ) Notice: Under 35 U.S.C. 154(b), the term of this patent shall be extended for 0 days.

(21) Appl. No.: 09/140,822

(22) Filed: Aug. 26, 1998

(51) Int. Cl.[7] ..... A45C 1/04

(52) U.S. Cl. ..... 224/666; 224/670; 224/918; 224/919; D3/257; D21/796

(58) Field of Search ..... 224/666, 670, 224/667, 668, 669, 918, 919; D3/221, 228, 257; 206/315.9; D21/796

(56) References Cited

U.S. PATENT DOCUMENTS

D. 252,422 * 7/1979 Gillenwater ..... D2/400
D. 332,176 * 1/1993 Mueller ..... D3/104
D. 349,550 * 8/1994 Reeves ..... D21/234
D. 360,974 * 8/1995 Stalling ..... D3/221
D. 374,472 * 10/1996 Nowak ..... D21/234
D. 374,604 * 10/1996 Hnatowicz et al. ..... D8/373
D. 405,860 * 2/1999 Hargrove ..... D21/796
D. 411,603 * 6/1999 Duran ..... D21/796
D. 414,538 * 10/1999 Harrison ..... D21/796
2,665,830 * 1/1954 Fowler ..... 224/919 X
3,233,802 * 2/1966 Ludwick ..... 224/5
3,688,802 * 9/1972 Benward ..... 224/245
4,927,052 * 5/1990 Marthaler et al. ..... 224/918
5,533,700 * 7/1996 Porter ..... 248/311.2
5,799,853 * 9/1998 Brewster ..... 224/666 X

* cited by examiner

*Primary Examiner*—Stephen K. Cronin
(74) *Attorney, Agent, or Firm*—Lalos & Keegan; Michael N. Lau

(57) ABSTRACT

A golf ball holder comprising a member having a hook section attachable to the wearing apparel of a user thereof, including a pair of leg portions, and a tray section formed integrally with and projecting laterally from a leg portion of the hook section, the tray section having an upper surface provided with least one recess for receiving and supporting a golf ball therein, having a surface engageable by a ball supported in the recess in an interference-fit relation, and the recess having an opening extending to an underside of the tray section of sufficient cross sectional area to permit a portion of a finger of the user to be inserted therethrough and dislodge a ball supported in the recess to propel the ball into the hand of the user cupped around the tray section.

11 Claims, 2 Drawing Sheets

GOLF BALL HOLDER

This invention relates to the recreational sport of golf and more particularly to an improved golf ball holder which may be detachably secured to the wearing apparel of the user to provide convenient access to a set of golf balls.

BACKGROUND OF THE INVENTION

In playing a round of golf, a player normally carries a set of clubs and irons and a set of balls. The balls usually are carried in a golf bag or perhaps in a pocket on the wearing apparel of the player. If a ball to be played is not readily accessible, it may disrupt the tempo of the player's game or cause him or her to lose his or her concentration on the game. It thus has been found to be desirable to provide a golf ball holder which would be readily accessible to the player and thus not disrupt the tempo of his or her game or cause him or her to lose concentration. It further is an object of the present invention to provide such an easily accessible golf ball holder that may be worn by the player, which will firmly hold a set of balls when the player is driving or putting a ball in play and which further will not interfere with any movement or motion of the player.

DESCRIPTION OF THE PREFERRED EMBODIMENT OF THE INVENTION

Figure 1:
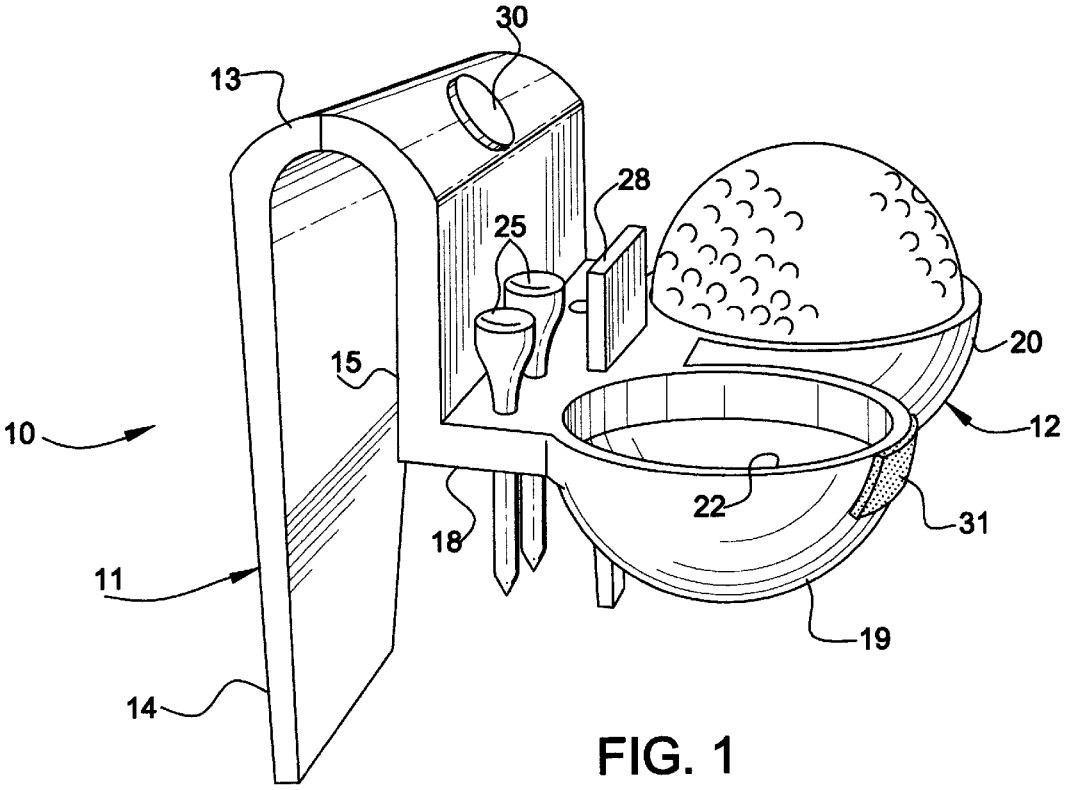
FIG. 1 of the drawings is a perspective view of an embodiment of the invention.
Figure 2:
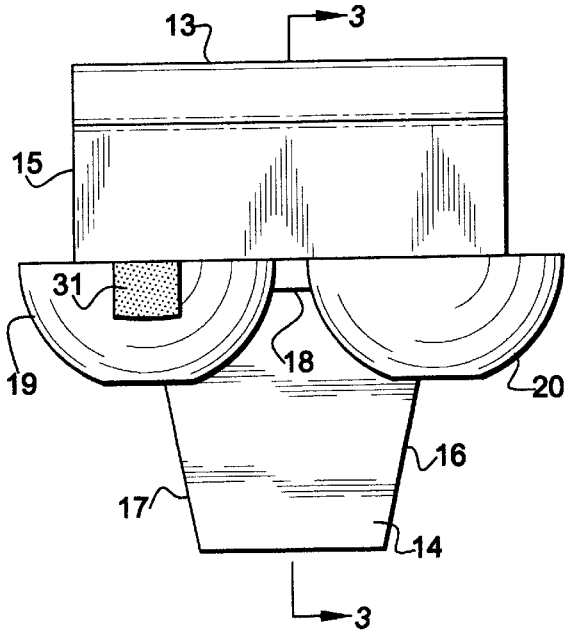
FIG. 2 is a front elevational view of the embodiment shown in FIG. 1.
Figure 3:
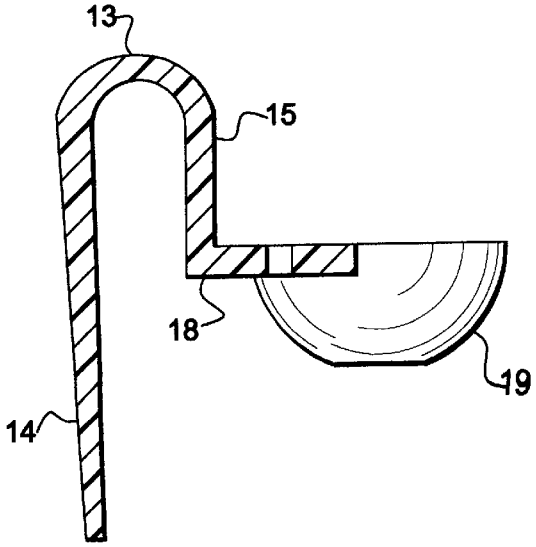
FIG. 3 is a cross sectional view taken along line 3—3 in FIG. 2.
Figure 4:
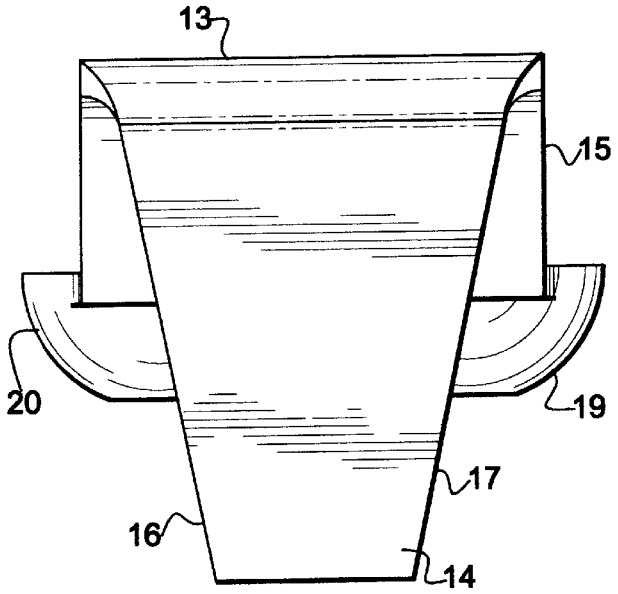
FIG. 4 is a rear elevational view of the embodiment shown in FIG. 1.
Figure 5:
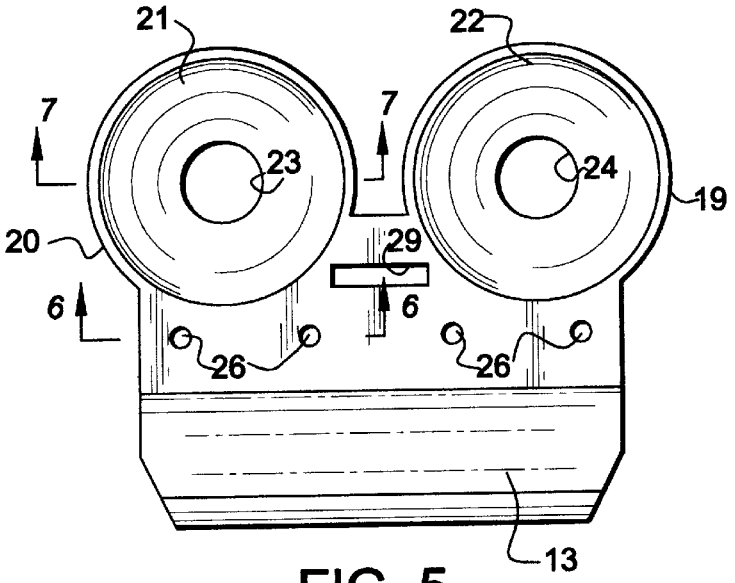
FIG. 5 is a top plan view of the embodiment shown in FIG. 1.
Figure 6:
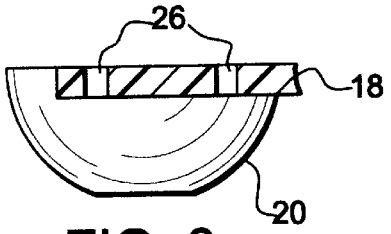
FIG. 6 is a cross sectional view taken along line 6—6 in FIG. 5.
Figure 7:
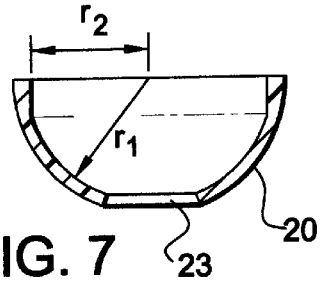
FIG. 7 is a cross sectional view taken along line 7—7 in FIG. 5.

Referring to the drawings, there is illustrated a golf ball holder 10 which embodies the present invention. The holder is of a one-piece, molded construction and includes a hook section 11 and tray section 12. The hook section has an inverted, U-shaped configuration including a curved, bight portion 13 and a pair of substantially parallel, depending leg portions 14 and 15. Leg portion 15 is substantially shorter than leg portion 14 and leg portion 14 is provided with converging side edges 16 and 17, as best shown in FIG. 4, to facilitate the insertion of leg portion 14 between a belt and the waistband of the wearing apparel of a player or perhaps the waistband of a pair of slacks and a shirt of the wearer, with the belt or upper portion of the waistband being received within the spaced opening between the leg portions, engaging the underside of the bight portion of the hook section. Tray section 12 includes a platform portion 18 formed integrally with the lower end of leg portion 15, and a pair of cup-shaped portions 19 and 20 projecting laterally of platform portion 18 and formed integrally therewith. The cup-shaped portions provide upwardly opening, concavely configured surfaces 21 and 22 which are adapted to receive and support a pair of golf balls. As best shown in FIGS. 5 and 7, concave surfaces 21 and 22 are provided with circular openings 23 and 24 at the lower ends thereof which have diameters substantially less than the diameter of the balls supported in the cup-shaped portions yet sufficiently large to permit a portion of a finger of a user to project therethrough from the under side of the cup-shaped portions.

The diameters of the upper ends of surfaces 21 and 22 are slightly smaller than the diameter of the balls supported therein so that there will be an inference fit when the balls are placed in the cup-shaped portions of the holder. Alternatively, the radius of curvature of surfaces 21 and 22 may be varied relative to the radius of curvature of the balls to be supported in the cup-shaped portions so that there similarly will be an interference of fit of the balls into the cup shaped portions of the holder. The configuration of each of surfaces 21 and 22 is selected so as to provide a sufficient gripping action of the balls press-fit into the cup-shaped portions yet insufficient to prevent balls thus gripped within the cup-shaped members to be dislodged by simply poking a portion of a finger through a bottom opening 23 and 24 into contact with the bottom portion of a ball thus gripped. As best shown in FIG. 7, an interference fit may be provided by forming the cup-shaped portions 19 and 20 so that the lower portions of concavely configured surfaces 21 and 22 will be formed with a radius of curvature of $r_1$ and the upper ends of such surfaces will be formed with a radius of curvature $r_2$ which is slightly less than $r_1$.

In addition to carrying a set of balls, the holder is adapted to carry a set of tees 25 in a set of openings 26 provided in platform portion 18, adapted to receive the shank portions of the tees therethrough, a divot tool 28 in a rectangularly configured opening 29 also provided in platform portion 18, adapted to receive the pronged portion of the tool therethrough, a ball marker 30 adhesively secured on the upper side of bight portion 13 and a glove which may be detachably secured to a Velcro patch 31 adhesively secured on an outer side of a cup-shaped portion 19 or 20.

The holder as described may be formed by any method and from any suitable material although it is preferred that the holder be formed as an integral unit by injection molding of a plastic such as polypropylene. Other plastic materials also may be used and the holder may be molded in different colors to enhance its appearance.

In the use of the holder, it may be removeably attached to the wearing apparel of the user simply by inserting leg portion 14 between the belt and waistband of the user or the waistband and shirt of the user so that the upper end of the belt or waistband is received between the leg portions of the hook section and engages the underside of the bight portion thereof. With the holder thus attached, a pair of golf balls may be press-fit into the cup-shaped portions thereof, a set of tees and a divot tool may be inserted in openings 26 and 29 and one or more ball markers may be adhesively secured to the bight portion of the hook section. The holder may be attached on the front, rear or side of the player's waist, in a position most comfortable to the player. With the balls firmly retained in the cup-shaped portions of the holder and the holder positioned at the desired position around the waist of the player, the player will be free to swing a club without interference of the holder and without concern of a ball becoming dislodged from one of the cup-shaped portions of the holder. Whenever the player desires to use one of the balls retained by the holder, he or she simply need insert a portion of a finger through a bottom opening 23 or 24 to dislodge a ball lightly gripped in a cup-shaped portion of the holder which will cause the ball to pop up into the palm of the hand of the player to permit the player to access and grip the ball in an easy motion so as not to disrupt the tempo of his or her game or cause him or her to lose his or her concentration in contemplating and making the next shot. The holder provides ready access to a ball and eliminates the searching of a ball in a pocket of the wearing apparel of the player or in a compartment of a golf bag.

From the foregoing detailed description, it will be evident that there are a number of changes, adaptations and modifications of the present invention which come within the province of those persons having ordinary skill in the art to which the aforementioned invention pertains. However, it is intended that all such variations not departing from the spirit of the invention be considered as within the scope thereof as limited solely by the appended claims.

I claim:

1. A golf ball holder comprising a member having a hook section attachable to the wearing apparel of a user thereof, including a pair of leg portions, and a tray section formed integrally with and projecting laterally from a leg portion of said hook section, said tray section having an upper surface provided with at least one substantially semispherically configured recess having a surface including a lower portion having a first radius of curvature and an upper portion having a second radius of curvature slightly less than said first radius of curvature to provide an interference fit of a ball received within and supported in said recess, and said recess having an opening extending to an underside of said tray section of sufficient cross-sectional area to permit a portion of a finger of the user to be inserted therethrough and dislodge a ball seated in said recess and propel the ball into the hand of the user cupped around said tray section.

2. A golf ball holder according to claim 1 when said member is formed of a plastic material.

3. A golf ball holder according to claim 1 wherein said member is formed of a molded plastic material.

4. A golf ball holder according to claim 1 wherein said member is formed of polypropylene.

5. A golf ball holder according to claim 1 wherein said hook section includes a first leg portion insertable between the waistband of a wearing apparel and the body of the user and a second leg portion shorter than and disposed essentially parallel to said first leg portion, and said tray section forms a continuation of said second leg portion and is disposed at a substantially right angle thereto.

6. A golf ball holder according to claim 5 wherein said first leg portion is provided with a pair of converging side edges facilitating the insertion thereof between said waistband and the body of the user thereof.

7. A golf ball holder according to claim 1 wherein a pair of recesses is provided in said tray section in side-by-side relation.

8. A golf ball holder according to claim 1 wherein said tray section is provided with a plurality of openings therethrough for receiving and retaining a set of golf tees.

9. A golf ball holder according to claim 1 wherein said tray section is provided with an opening therethrough for receiving and retaining a divot tool.

10. A golf ball holder according to claim 1 wherein said member includes means for detachably securing a glove thereon.

11. A golf ball holder according to claim 10 wherein said securing means comprises a patch of a hook and loop type fastener mounted on said tray section.

* * * * *